US009505551B2

(12) United States Patent
Elliot

(10) Patent No.: US 9,505,551 B2
(45) Date of Patent: Nov. 29, 2016

(54) CANGAROO SHARPENER WITH DISPOSABLE POUCH

(71) Applicant: Cherie Ann Elliot, Grand Prairie, TX (US)

(72) Inventor: Cherie Ann Elliot, Grand Prairie, TX (US)

( * ) Notice: Subject to any disclaimer, the term of this patent is extended or adjusted under 35 U.S.C. 154(b) by 0 days.

(21) Appl. No.: 14/170,587

(22) Filed: Mar. 22, 2014

(65) Prior Publication Data

US 2015/0266625 A1 Sep. 24, 2015

(51) Int. Cl.

| | |
|---|---|
| ***B65F 1/00*** | (2006.01) |
| *B43L 23/00* | (2006.01) |
| *B43L 23/08* | (2006.01) |

(52) U.S. Cl.

CPC ..... *B65F 1/0006* (2013.01); *B43L 23/08* (2013.01); *Y10T 29/49874* (2015.01)

(58) Field of Classification Search

CPC ..... Y10T 29/49826; Y10T 29/4987
USPC ..... 428/34.1; 144/28.1, 28.6, 28.7, 28.11; 206/224, 216, 223
See application file for complete search history.

(56) References Cited

U.S. PATENT DOCUMENTS

| | | | | |
|---|---|---|---|---|
| 2,525,854 | A * | 10/1950 | Becker | B43L 23/08 30/454 |
| 3,667,516 | A * | 6/1972 | Grosjean | 144/28.11 |
| 3,980,113 | A * | 9/1976 | Birdsall | 144/28.6 |
| 3,998,253 | A * | 12/1976 | Kerr, Jr. | 144/28.1 |
| 6,065,514 | A * | 5/2000 | New | B43L 23/08 144/28.1 |
| 6,845,795 | B2 * | 1/2005 | Lammers et al. | 144/28.5 |
| 6,921,202 | B2 * | 7/2005 | Raterman | B65F 1/0006 383/33 |
| 2005/0145086 | A1 * | 7/2005 | Mohr | B43L 23/08 83/651 |
| 2009/0074332 | A1 * | 3/2009 | Bonke | B65F 1/0006 383/33 |
| 2014/0219584 | A1 * | 8/2014 | Hutchins | B65F 1/002 383/33 |

FOREIGN PATENT DOCUMENTS

| | | | | |
|---|---|---|---|---|
| CN | 202085899 | * | 12/2011 | A45C 11/34 |

* cited by examiner

*Primary Examiner* — David Bryant
*Assistant Examiner* — Lawrence Averick
(74) *Attorney, Agent, or Firm* — Law Office of Jeff Williams; J. Oliver Williams

(57) ABSTRACT

The product of invention is to attach a removable, disposable pouch to pencil sharpeners. Each pouch is stretched over the body of a pencil sharpener to catch pencil shavings.

A stretch band is placed over the pouch at the top edge of the pouch and sharpener to secure pouch and show product branding.

When the pouch is full of shavings the pouch is removed and disposed of. A new pouch is then attached to the pencil sharpener. Pouches will be offered in a variety of designs and colors.

1 Claim, 3 Drawing Sheets

CANGAROO SHARPENER WITH DISPOSABLE POUCH

BACKGROUND OF INVENTION

The Cangaroo Sharpener With Disposable Pouch is a pencil sharpener with a removable disposable pouch. Attaching the disposable pouch to a standard or cosmetic one or two hole sharpener is what makes the Cangaroo Sharpener With Disposable Pouch unique from anything on the market and the object of invention. The disposable pouch eliminates the mess and inconvenience of disposing of pencil shavings. The attaching of the pouch is identical for all size pencil sharpeners and the object of invention. Approximate overall dimension of the Cangaroo Sharpener is 2" wide×2½" long.

The Cangaroo Sharpener With Disposable Pouch patent should include patent rights and exclusivity for attaching a removable, disposable pouch to all pencil sharpeners that sharpen regular lead pencils, art pencils and cosmetic pencils of all sizes, single and double hole handheld pencil sharpeners. Because of the added pouch the Cangaroo Sharpener With Disposable Pouch has the ability to be carried in cosmetic cases, purses, student's bags, utilized for school and art classes and/or with any person that needs a pencil sharpener in day to day activities without the sharpener container breaking open and spilling shaving contents.

The pouch will be made from natural latex or latex free materials. Natural latex from the rubber plant is biodegradable. The Cangaroo Sharpener disposable pouches will be available in a variety of colors and designs.

The single and double hole pencil sharpeners that will be used as a component, are already in existence and are currently in the marketplace. The pencil sharpener is not the non-provisional patent object. The object of invention for the non-provisional patent is attaching a removable, disposable latex or latex free pouch to any existing cosmetic or standard pencil sharpener. The disposable latex pouch is attached to the outside of the pencil sharpener, then a 0.625"-0.75" wide stretch band is stretched over the top edge of the pouch securing the pouch to the pencil sharpener.

DETAILED DESCRIPTION OF THE PREFERRED EMBODIMENT

Figure 1:
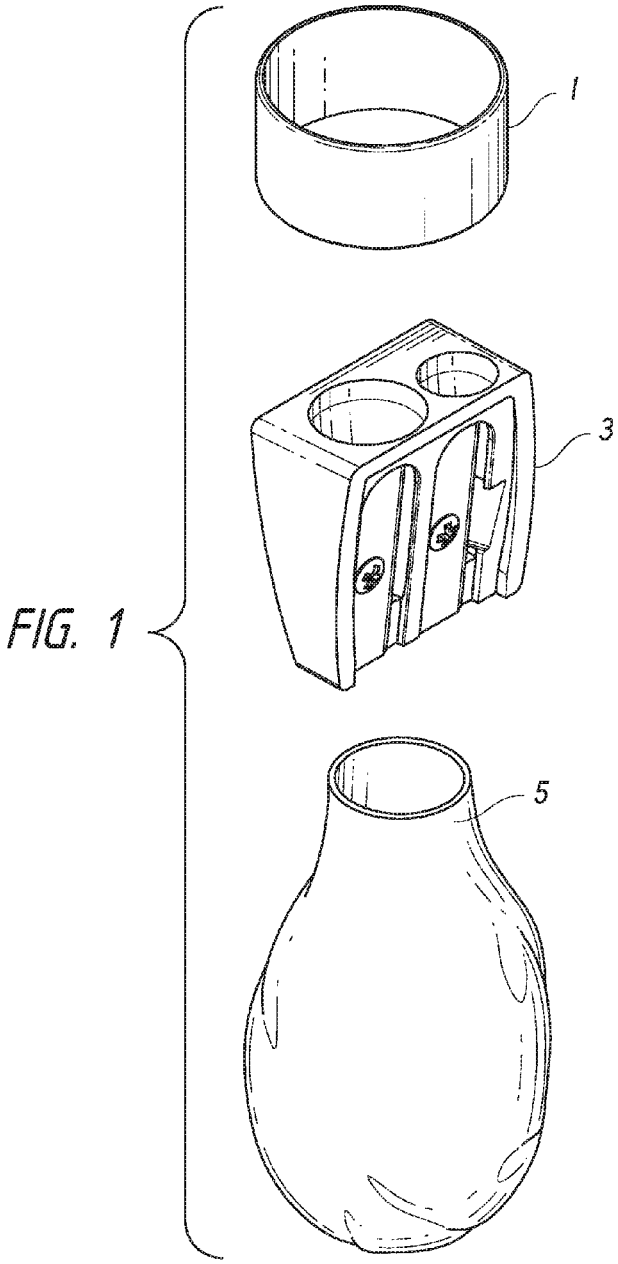
FIG. 1 is an exploded perspective view of a cangaroo sharpener with disposable pouch according to the present application.
Figure 1A:
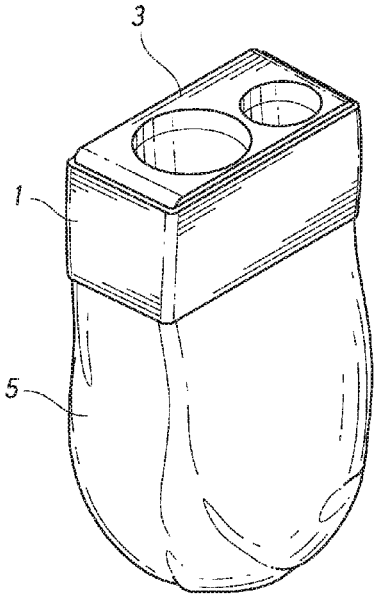
FIG. 1A is a perspective view of the cangaroo sharpener with disposable pouch of FIG. 1.

In regards to FIG. 1, an exploded perspective view of a cangaroo sharpener with disposable pouch according to the present application is shown.

The front view (the back view is a mirror image) of the stretch band that will be stretched over the sharpener at the top edge of the latex or latex free pouch which has been attached to the pencil sharpener. The top view of the stretch band. The bottom view of the stretch band is a mirror image. The top view of a standard double hole pencil sharpener. Not the object of a provisional patent, but a component that will be used. Standard single hole pencil sharpeners will also be used as a component.

The front view of a standard double hole pencil sharpener, not the object of a provisional patent, but a component that will be used. Standard single hole pencil sharpeners will also be used as a component. The pencil sharpeners are inserted into the removable, disposable pouch.

The front view of a pouch. The back view of a pouch is the mirror image of the front view. Attaching a removable, disposable pouch to a standard single or double hole pencil sharpener is the object of invention and non provisional patent.

Figure 2:
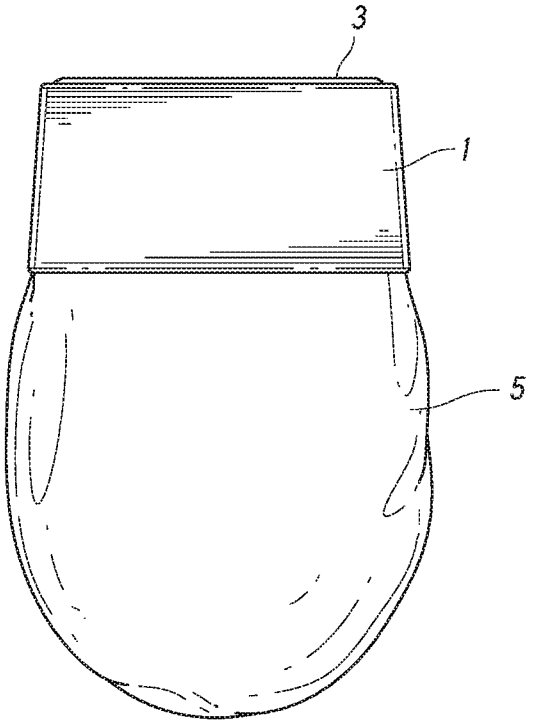
FIG. 2 is a front view of the cangaroo sharpener with disposable pouch of FIG. 2.

Referring now also to FIG. 2 in the drawings, a front view of the cangaroo sharpener with disposable pouch is illustrated.

The 0.625"-0.75" wide stretch band is shown. The front and back view of the top edge of the standard double or single hole sharpener that is exposed after it is inserted into a removable, disposable pouch and the stretch band has been placed over both the sharpener and the pouch is also seen in the respective figure. The front and back view of the disposable pouch. The front and back view of the pouch are mirror images.

Dimensions of the Cangaroo Sharpener With Disposable Pouch will vary depending on whether a single hole or double hole pencil sharpener is inserted in the pouch. The approximate overall dimension of the double hole sharpener with disposable pouch is 1¾" wide at the top end, approximately 2" wide at the widest part of the pouch and approximately 2½" long from top of pencil sharpener to bottom of pouch. There will be variances in pouch dimensions due to the flexible nature of latex or latex free materials.

Figure 3:
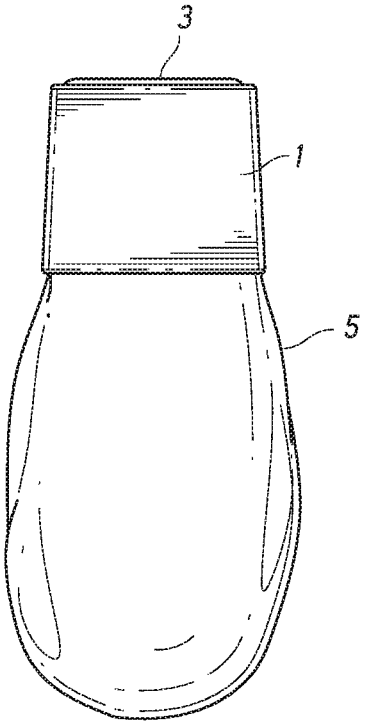
FIG. 3 is a side view of the cangaroo sharpener with disposable pouch of FIG. 2.

Referring now also to FIG. 3 in the drawings, a side view of the cangaroo sharpener with disposable pouch is illustrated.

Side View-Both Sides are Mirror Images

A Side view of the stretch band is seen. The portion of the standard double or single hole sharpener that is exposed after it is inserted into a disposable pouch and the stretch band has been placed over both sharpener and pouch is also shown. The side view of disposable pouch is shown below the stretch band.

The approximate dimension of the double hole sharpener with disposable pouch is ¾" wide at the top end, approximately 2" wide at the widest part of the pouch and approximately 2½" long from top of pencil sharpener to bottom of pouch. There will be variances in pouch dimensions due to the flexible nature of latex or latex free materials.

Figure 4:
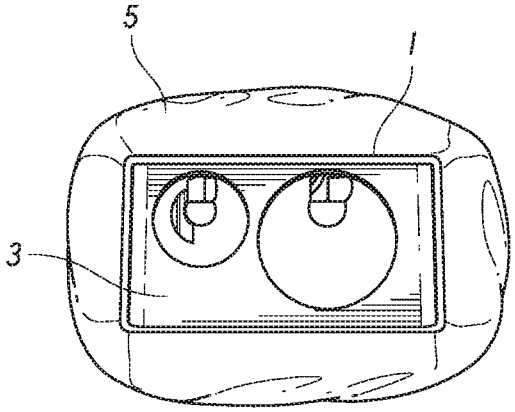
FIG. 4 is a top view of the cangaroo sharpener with disposable pouch of FIG. 2.

Referring now also to FIG. 4 in the drawings, a top view of the cangaroo sharpener with disposable pouch is illustrated.

A Top View of the stretch band is shown around the sharpener. The top portion of the standard double or single hole sharpener that is exposed after it is inserted into a removable, disposable pouch and the stretch band has been placed over both sharpener and pouch.

A Top View of the removable, disposable pouch is seen in communication with the sharpener.

Dimensions will vary depending on whether a single hole or double hole pencil sharpener is used. The approximate dimension of the double hole sharpener with disposable pouch is 1 7/16"L×¾" wide at the pencil sharpener top end, approximately 2" wide at the widest part of the pouch and approximately 2½" long from top of pencil sharpener to bottom of pouch. There will be variances in pouch dimensions due to the flexible nature of latex or latex free materials.

The removable, disposable latex or latex-free pouch neck opening is stretchable to accommodate the variances in width and length of a single or double hole standard and/or cosmetic pencil sharpener.

Figure 5:
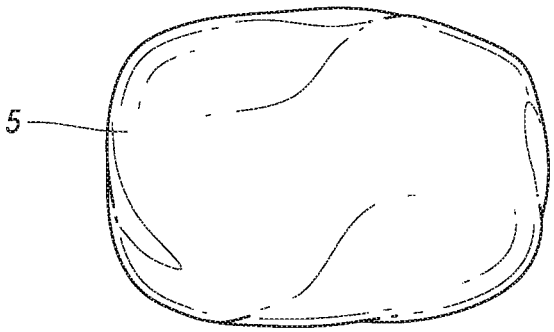
FIG. 5 is a bottom view of the cangaroo sharpener with disposable pouch of FIG. 2.

Referring now also to FIG. 5 in the drawings, a bottom view of the cangaroo sharpener with disposable pouch is illustrated.

Dimensions will vary depending on whether a single hole or double hole pencil sharpener is used. The approximate dimension of the bottom view of the pouch is 1¾" left to right and top to bottom. There will be slight variances in pouch dimensions due to the flexible nature of latex or latex free materials.

The invention claimed is:

1. A method of catching pencil shavings from a pencil sharpener, the method comprising:

providing a pencil sharpener, a disposable pouch and a stretch band, the disposable pouch being flexible;

stretching the disposable pouch around a portion of the pencil sharpener, such that the pouch defines a volume for capturing the pencil shavings;

placing the stretch band over a top edge of the pouch to further secure the pouch to the pencil sharpener;

catching pencil shavings created by the pencil sharpener within the disposable pouch;

removing the pouch from the pencil sharpener, the pouch retaining the pencil shavings;

disposing of the removed pouch; and attaching a new pouch to the pencil sharpener;

wherein the pouches may include product branding visible to the user of the pouches and the pencil sharpener, and the pouches may be provided in a variety of designs and colors.

* * * * *